US008656982B2

(12) United States Patent
Takashina et al.

(10) Patent No.: US 8,656,982 B2
(45) Date of Patent: Feb. 25, 2014

(54) PART FOR REMOVING IMPURITIES FROM A MOLTEN METAL

(75) Inventors: Shigeaki Takashina, Toyohashi (JP); Tokuo Tsuura, Tokyo (JP); Tomoaki Kawabata, Wakayama (JP); Daisuke Barada, Shizuoka (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 13/314,014

(22) Filed: Dec. 7, 2011

(65) Prior Publication Data

US 2012/0138255 A1 Jun. 7, 2012

Related U.S. Application Data

(62) Division of application No. 12/518,823, filed as application No. PCT/JP2007/074352 on Dec. 12, 2007, now abandoned.

(30) Foreign Application Priority Data

Dec. 12, 2006 (JP) ..... 2006-334512

(51) Int. Cl.
*B22D 1/00* (2006.01)

(52) U.S. Cl.
USPC ..... 164/244; 164/266

(58) Field of Classification Search
USPC ..... 164/266, 244
See application file for complete search history.

(56) References Cited

U.S. PATENT DOCUMENTS

| | | | | |
|---|---|---|---|---|
| 3,893,917 | A * | 7/1975 | Pryor et al. | 75/411 |
| 4,591,383 | A * | 5/1986 | McGarry et al. | 75/407 |
| 4,928,746 | A | 5/1990 | Butler et al. | |
| 4,961,460 | A | 10/1990 | Butler et al. | |
| 5,404,930 | A | 4/1995 | Stanton et al. | |
| 6,224,818 | B1 * | 5/2001 | Hitchings et al. | 266/45 |
| 2004/0069429 | A1 | 4/2004 | Tsuura et al. | |
| 2004/0238152 | A1 * | 12/2004 | Campomanes et al. | 164/358 |
| 2006/0096263 | A1 | 5/2006 | Kahlbaugh et al. | |
| 2008/0105401 | A1 | 5/2008 | Nakai et al. | |

FOREIGN PATENT DOCUMENTS

| | | | |
|---|---|---|---|
| EP | 1488871 | A1 | 12/2004 |
| EP | 1577034 | A1 | 9/2005 |
| EP | 1757383 | A1 | 2/2007 |
| JP | 1-224139 | A | 9/1989 |
| JP | 2-30117 | Y2 | 8/1990 |
| JP | 5-9736 | U | 2/1993 |
| JP | 5-60659 | U | 8/1993 |
| JP | 2004-131482 | A | 7/2004 |
| JP | 2004-195547 | A | 7/2004 |
| JP | 2005-153003 | A | 6/2005 |
| JP | 2006-224189 | A | 8/2006 |
| WO | WO 2005/120745 | A1 | 12/2005 |

OTHER PUBLICATIONS

Chinese Office Action for Application No. 200780045680.7 dated Feb. 14, 2012 (with English translation).

(Continued)

*Primary Examiner* — Erin Saad

(74) *Attorney, Agent, or Firm* — Birch, Stewart, Kolasch & Birch, LLP

(57) ABSTRACT

The present invention arranges the part for removing impurities from a molten metal containing a filter holder constituted of a structure containing an organic fiber, an inorganic fiber and thermosetting resin and a heat-resistant filter in the runner of the mold.

24 Claims, 8 Drawing Sheets

(56) References Cited

OTHER PUBLICATIONS

Japanese Notice of Ground of Rejection dated Nov. 15, 2011 for Japanese Application No. 2007-319736.
Chinese Office Action, dated Sep. 9, 2010, for Chinese Application No. 200780045680.7.
English Translation of Chinese Office Action dated Oct. 10, 2011, for Chinese Application No. 200780045680.7.
Offical Website of Kinsei Matec Co., Ltd., <http://www.kinseimatec.co.jp/en/product/4/12/2011>.
Extended European Search Report dated Jul. 6, 2012 for European Application No. 07850838.9.
Full English machine translation of JP-5-9736-U dated Feb. 9, 1993.
Chinese Office Action, dated Aug. 3, 2012, for corresponding Chinese Application No. 200780045680.7, along with English translation thereof.

* cited by examiner

PART FOR REMOVING IMPURITIES FROM A MOLTEN METAL

FIELD OF THE INVENTION

The present invention relates to a part for removing slag and other impurities from a molten metal in casting, a mold using the part and a method for producing a cast article using the mold.

BACKGROUND OF THE INVENTION

In casting, impurities such as slag contaminated in a molten metal, if it remains through a final product, can cause cast defects in the product. There are various causes of contamination of impurities such as oxidation of a material to be molten and a molten metal, a fallen part of a mold and contamination of a mold material. It is in fact almost impossible to avoid the contamination. In practical operation, efforts for reducing the contamination as small as possible and for avoiding the contamination in a product by devising a process of casting are generally made. One of such efforts is a method of arranging a filter made of a fire-resistant material such as ceramics in a runner system including a sprue, a runner and a gate to remove impurities from a molten metal. This method is often employed, because it has high reliability.

This method, however, cannot use a filter having so small mesh due to limitation of running resistance, and thus is effective for removing relatively large impurities such as slug, but not for small impurities such as mold sand. In the case of producing a cast article particularly disliking a defect due to contamination of impurities, employed is a method of using a runner tube made of a fire-resistant material in a runner system to avoid contamination of sand from a mold and removing slug and the like from a molten metal with a filter. However, it is difficult to set a runner tube and a filter on uncured mold sand to form a mold in forming a mold, because the uncured sand is unstable and not suitable for positioning. This method may further cause other defects such as break of the filter and contamination of sand in the runner tube.

To solve these problems, those are proposed, including a molded molten metal passage having a filter set part integrally formed (JP-Y2-30117), a mold having a sprue and a filter which are integrated with a fire-resistant sleeve (JP-A1-224139) and a sintered fire-resistant filter holder for molten metal having a construction of connecting a runner and holding a filter (JP-U5-9736). JP-A-2004-181472 discloses a mold or a structure for producing a cast article, containing organic and inorganic fibers and a thermosetting resin. In this patent, there is no description about a filter holder nor an object of this invention.

SUMMARY OF THE INVENTION

The present invention relates to a part for removing impurities from a molten metal, containing a filter holder constituted of a structure containing an organic fiber, an inorganic fiber and a thermosetting resin and a heat-resistant filter.

The present invention also relates to a mold for producing a cast article containing the part for removing impurities from a molten metal of the present invention, and to a method for producing a cast article with the mold.

The present invention also relates to a filter holder for producing a cast article, containing an organic fiber, an inorganic fiber and a thermosetting resin.

DETAILED DESCRIPTION OF THE INVENTION

The conventional techniques have the following problems. JP-Y2-30117 describes a construction of the molten metal passage as that a filter is integrally set in an expansion chamber provided in the passage. However, there is no description of specific process and effect in practice such as workability in casting. In addition, since a passage (runner) tube is made of an alumina-based and/or mullite-based material having erosion-resistant and fire-resistant properties, after releasing a frame, the runner tube itself is non-reusable waste. It requires effort and cost for disposal.

JP-A1-224139 describes a method of casting with a mold having a sprue and a filter integrated therewith and intends to increase a yield of molten metal without a runner. However, the mold with a sprue only can generally produce small and light articles only. In Examples of JP-A1-224139, a maximum weight of produced ductile iron was 23.15 kg of casting weight. In other words, the method has limited applications, or low possibility.

JP-U5-9736 describes a sintered fire-resistant structure made of silica/alumina-based chamotte having a construction of connecting a runner and holding a filter for molten metal. This structure is effective for improving workability in forming a mold, but has a disadvantage of much effort and cost for disposal, because it becomes a non-reusable waste after releasing a frame. In addition, since both of the filter holder and the filter are prepared by forming a material and sintering, they are likely to change their shapes and have poor flexibility, and when they are assembled, the filter can generate unexpected distortion. In some cases, the distorted filter may be broken by an external force in forming a mold or by thermal strain in pouring a molten metal. The structure totally has possibility of generating a cast defect.

The invention provides a part for removing impurities from a molten metal, that improves effort and cost for disposal, prevents filter break, is applicable to production of large and heavy cast articles, and can produce a cast article of high strength and high quality.

The present inventers have found that arrangement of a part for removing impurities from a molten metal containing a filter holder containing an organic fiber, an inorganic fiber and a thermosetting resin and a heat-resistant filter in a runner system can solve the problems.

According to the present invention, the following effects are provided.

1. The filter holder used in the present invention has necessary and sufficient strength at normal temperature in forming a mold, and hot strength and shape retention in casting, while having lighter weight than a ceramic filter. Since the part for removing impurities from a molten metal using the filter holder also has lighter weight and is integrated with a heat-resistant filter, the part has good workability in forming a mold, and a runner can be placed at a predetermined position. The filter holder used in the present invention can prevent break of the heat-resistant filter, and less likely cause contamination of mold sand in a runner system in forming a mold. Therefore, the filter can fully demonstrate its intended performance of removing slag and the like.

2. In the filter holder used in the present invention, the organic fiber burns with heat in casting. The structure thus reduces its weight and density. When releasing a frame, the structure has lighter weight and lower density than those before casting, and thus can be easily removed. Therefore, aftertreatment is simple and an amount of waste is reduced.

3. The filter holder used in the present invention can further enhance the effect 1 by having a construction of allowing fitting and connecting with a runner tube.

4. By these effects 1 to 3, a cast article having less cast defects derived from slug and mold sand and causing less processing troubles such as chipping of a tip tool due to sand inclusion can be efficiently produced at low cost.

The present invention will be described in detail based on a preferred embodiment thereof.

The structure to form a filter holder used in the present embodiment contains an organic fiber, an inorganic fiber and a thermosetting resin.

From the viewpoints of functions as a filter holder and demonstration of the effect of the present invention, a composition ratio of organic fibers:inorganic fibers:thermosetting resin is preferably 1 to 50 parts by weight:1 to 40 parts by weight:2 to 50 parts by weight, more preferably 20 to 50 parts by weight:10 to 40 parts by weight:20 to 50 parts by weight, and even more preferably 30 to 50 parts by weight:10 to 30 parts by weight:20 to 40 parts by weight, in 100 parts by weight of the total of these three components.

From the viewpoints of heat resistance and economic efficiency, the structure preferably contains inorganic particles. In this case, percentages of organic fibers, inorganic fibers, inorganic particles and a thermosetting resin are: preferably 1 to 50 parts by weight, more preferably 2 to 40 parts by weight, and even more preferably 4 to 30 parts by weight for organic fibers; preferably 1 to 40 parts by weight, more preferably 2 to 30 parts by weight, and even more preferably 4 to 20 parts by weight for inorganic fibers; preferably 10 to 95 parts by weight, more preferably 20 to 90 parts by weight, and even more preferably 30 to 85 parts by weight for inorganic particles; and preferably 2 to 50 parts by weight, more preferably 4 to 40 parts by weight, and even more preferably 6 to 30 parts by weight for the thermosetting resin, in 100 parts by weight of the total of these four components.

The lower and the upper limits of the ratio of organic fibers are preferably determined based on formability and strength at normal temperature and on a surface defect of a cast article according to increased amount of gas generated from the structure in casting, respectively.

The lower and the upper limits of the ratio of inorganic fibers are preferably determined based on shape retention of the structure in casting and on formability of the structure and removability of the structure after casting, respectively.

The lower and the upper limits of the ratio of inorganic particles are preferably determined based on heat resistance of the structure in casting and on formability of the structure and shape retention of the structure in casting, respectively.

The lower and the upper limits of the ratio of the thermosetting resin are preferably determined based on strength at normal temperature, shape retention in casting, and surface smoothness of the structure and on a surface defect of a cast article according to increased amount of gas generated from the structure in casting, respectively.

The organic fiber is a component mainly serving as a skeleton of the structure to contribute to strength retention at normal temperature in the state before casting and increasing formability of the structure.

Examples of the organic fiber include paper, fibrillated synthetic and recycled fibers (e.g., rayon fiber). These organic fibers may be used alone or in combination of two or more of them. Among them, particularly preferably used are paper fibers, because it can be formed into various shapes by papermaking and has sufficient strength after dehydration and drying.

Examples of the paper fiber include wood, cotton, linter and non-wood pulps such as bamboo and straw. Virgin or recycled pulp of them may be used alone or in combination of two or more of them. The paper fiber is particularly preferably a recycled pulp, from the points of availability, environmental protection and reduced production cost.

Considering formability, surface smoothness and impact resistance of the structure, the organic fiber preferably has an average fiber length of 0.3 to 2.0 mm, and particularly preferably 0.5 to 1.5 mm.

The inorganic fiber is a component mainly serving for maintaining a shape of the structure without burning by heat of a molten metal in casting.

Examples of the inorganic fiber include artificial mineral fibers such as carbon fiber and rock wool, ceramic fibers and natural mineral fibers. These inorganic fibers may be used alone or in combination of two or more of them. Among them, preferred are carbon fibers. From the point of effectively controlling contraction according to carbonation of the thermosetting resin, more preferred are pitch-based and polyacrylonitrile (PAN)-based carbon fibers. PAN-based carbon fibers are particularly preferred.

From the viewpoints of dehydration properties of the structure in papermaking and dehydrating, formability of the structure, and uniformity, the inorganic fiber preferably has an average fiber length of 0.2 to 10 mm, and particularly preferably 0.5 to 8 mm.

The inorganic particle is a component for increasing heat resistance of the structure.

Examples of the inorganic particle include inorganic particles having a refractoriness of not less than 800° C. and preferably 1000 to 1700° C. such as silica, alumina, mullite, magnesia, zirconia, mica, graphite and obsidian. From the viewpoints of high viscosity in a softened state and softening by heat of a molten metal to form a compact fireproof film, preferred are obsidian and mullite powders. These inorganic particles may be used alone or in combination of two or more of them. The inorganic particle used preferably has a particle diameter of not more than 200 μm. Particularly preferred are inorganic particles having ±300° C., preferably ±200° C. refractoriness relative to a casting temperature of a molten metal. In the present invention, a refractoriness of the inorganic particle is measured by a method using a Seger cone (JIS R2204).

Examples of the thermosetting resin include phenol, epoxy and furan resins. The thermosetting resin is a component for increasing strength at normal temperature and hot strength or shape retention in casting of the structure.

The thermosetting resin used is particularly preferably a phenol resin, from the points of generation of small amount of flammable gas, combustion suppressing effects, high residual carbon rate of 25% or more after pyrolysis (carbonization) and formation of a carbon film in casting to provide good cast surface. A residual carbon rate can be determined by measuring a residual weight after heating at 1000° C. under a reduction atmosphere (nitrogen atmosphere) by differential calorimetry.

Examples of the phenol resin include resol phenol resins, novolak phenol resins and modified phenol resins with urea, melamine, epoxy, or the like. Preferred are resol phenol resins or modified resins thereof.

These thermosetting resins may be used alone or in combination of two or more, or may be used together with an acrylic resin or a polyvinyl alcohol resin.

The thermosetting resin may be added by being coated on the organic fiber, the inorganic fiber or the inorganic particles. It may be added as powder or emulsion thereof added to a slurry of raw materials. It may be added by be bound to the organic fibers, the inorganic fibers and the inorganic particles in the structure formed by papermaking and dried. It is added, as an agent for reinforcing the structure, by soaking a structure formed by papermaking with the agent and then drying or curing the structure. The strength of the structure is maintained in casting by carbonization by heat of a molten metal. The thermosetting resin can be added in any form as long as it can carbonize in casting by heat of a molten metal to form a carbon film and can contribute to keep strength of the structure.

When the novolak phenol resin is used, a hardening agent is required. The hardening agent is easy to dissolve in water, and thus preferably applied to a formed structure after dehydration particularly in wet papermaking. The hardening agent used is preferably hexamethylenetetramine and the like.

The structure containing the organic fibers, the inorganic fibers, the inorganic particles and the thermosetting resin of the present embodiment may further contain other ingredients such as a paper durability reinforcing agent (e.g., polyvinyl alcohol, carboxymethylcellulose (CMC), polyamideamine epichlorohydrin resin), a coagulant (e.g., polyacrylamide-based coagulants) and a colorant at any amount according to need.

A thickness of the structure of the present embodiment can be set to any value according to a part in which the structure is used, but preferably set to a thickness of 0.2 to 5 mm, particularly 0.4 to 2 mm at least at a part contacting with a molten metal. Too thin structure has insufficient strength for forming a mold by filling a heat-resistance aggregate. Too thick structure increases an amount of gas generated in casting and is likely to cause surface defects on a cast article, and in some cases, takes longer time for forming a mold to increase a production cost. As used herein, a thickness of the structure refers a thickness of parts excluding a reinforcing rib serving mainly to impart mechanical strength to the structure and parts (irregularities and protrusions) serving to impart connecting strength with the heat-resistant aggregate.

When the structure of the present embodiment is produced through a papermaking step with an aqueous raw slurry, a water content (by weight) of the structure is preferably not more than 10%, and particularly preferably not more than 8% before casting, from the point of minimizing an amount of gas generating in casting.

From the viewpoint of workability in forming a mold due to lightness, a specific gravity of the structure of the present embodiment is preferably not more than 1.0, and particularly preferably not more than 0.8 in the state before forming a mold.

Examples of a method for producing the structure of the present embodiment include a method of wet papermaking. The method of wet papermaking contains: preparing a raw slurry containing the organic fibers, the inorganic fibers, the inorganic particles and the thermosetting resin in the composition described above; subjecting the raw slurry to wet papermaking to give a fiber laminate having a predetermined shape; and dehydrating and drying the fiber laminate to give the structure.

Examples of a dispersant of the raw slurry include water, white water and solvents such as ethanol and methanol. Among them, from the points of stability in papermaking and dehydrating, stability in quality, cost, and easiness to use, water is particularly preferred.

A percentage of the total of the fibers and the inorganic particles to the dispersant in the raw slurry is preferably 0.1 to 10% by weight, and particularly preferably 0.5 to 6% by weight. The raw slurry containing too much amount of the fibers and the inorganic particles in total is likely to cause uneven thickness in the structure. The raw slurry containing too small amount may cause a thin spot in the structure.

The raw slurry may further contain additives such as the paper durability reinforcing agent, the coagulant, and an antiseptic at any amount according to need.

In the step of papermaking of the fiber laminate, for example, a papermaking mold having a shape generally corresponding to a shape of the structure and many communication holes communicating with the back surface of the mold is covered with a net having a mesh on a pulp-screening face of the mold. In papermaking, into the mold set in the direction that the pulp-screening face is upward may be poured the raw slurry and deposited, or the mold may be immersed in the raw slurry and sucked from the back surface of the mold to deposit the raw slurry.

A fiber laminate having a predetermined thickness formed on the net on the papermaking mold is dehydrated to a predetermined water content by, for example, passing the air through the fiber laminate according to need.

The fiber laminate is then dried and shaped. In this drying and shaping step, any method can be used as long as the structure having a desired shape can be obtained. For example, the fiber laminate is sandwiched between a pair of inner and outer drying molds produced corresponding to the desired shape of the structure, and dried and shaped. A heat temperature of the drying molds (mold temperature) is preferably 180 to 250° C. and particularly preferably 200 to 240° C., from the viewpoints of a drying time for the lower limit and a surface appearance detracted by burning for the upper limit.

When the fiber laminate as is has the desired shape of the structure, the fiber laminate may be directly dried with a hot-air drier and the like. In this case, an atmosphere temperature is preferably 160 to 240° C. and particularly preferably 180 to 220° C., from the viewpoints of a drying time for the lower limit and pyrolysis of the organic fibers for the upper limit.

The resultant structure may be partially or wholly soaked with a binder and thermally cured by heat according to need. Examples of the binder include colloidal silica, ethyl silicate and liquid glass.

The structure is preferably thermally treated to progress hardening of the thermosetting resin. Such a thermal treatment provides a structure having better shape retention properties. The thermal treatment may be combined with the drying and shaping step, or may be performed separately with a hot-air drier and the like.

In the above description, the desired shape of the structure is produced in wet papermaking, and dried and shaped. It is also possible to produce a fiber laminate sheet by wet papermaking and sandwich the sheet in a wet state between a pair of inner and outer drying molds produced corresponding to the desired shape of the structure to be dried and shaped. Alternatively, the fiber laminate sheet may be dried as a sheet, and appropriately processed such as cutting, folding and adhering to produce the desired shape of the structure. Adhesion may be with an adhesive, an adhesive tape, a pin or a tack. Adhesion is preferably with an adhesive, and more preferably with a thermosetting resin adhesive.

The heat-resistant filter used in the present embodiment may be of any form including mesh, perforated (i.e., lotus root-shaped), honeycomb, and foam. Among them, in the case of an evaporative pattern casing method, perforated and honeycomb filters are preferred, because an amount of molten metal or a flow rate of molten metal passed through the heat-resistant filter is large, resulting in higher strength. In the case of a wood mold casting method, foam filters are preferred from the viewpoint of filtering efficiency. The heat-resistant filter is preferably made of ceramics. Examples of a ceramic material include silica, magnesia, alumina, mullite, zirconia, silicon carbide and cordierite. Ceramics of single and composite materials may be appropriately selected according to a casting material and a casting temperature. Among them, from the viewpoint of heat resistance, ceramics of single and composite materials containing silica, alumina, mullite, zirconia and silicon carbide are preferred. For materials cast at high temperature such as steel, ceramics mainly composed of zirconia and silicon carbide are particularly preferred. The heat-resistant filter of any shape can be used, including quadrangles such as a square and a rectangle and circles including an ellipse and an oval.

BRIEF DESCRIPTION OF THE DRAWINGS

FIG. 15 is a state photograph of a heat-resistant filter after casting in Comparative Example 4.

Figure 1:
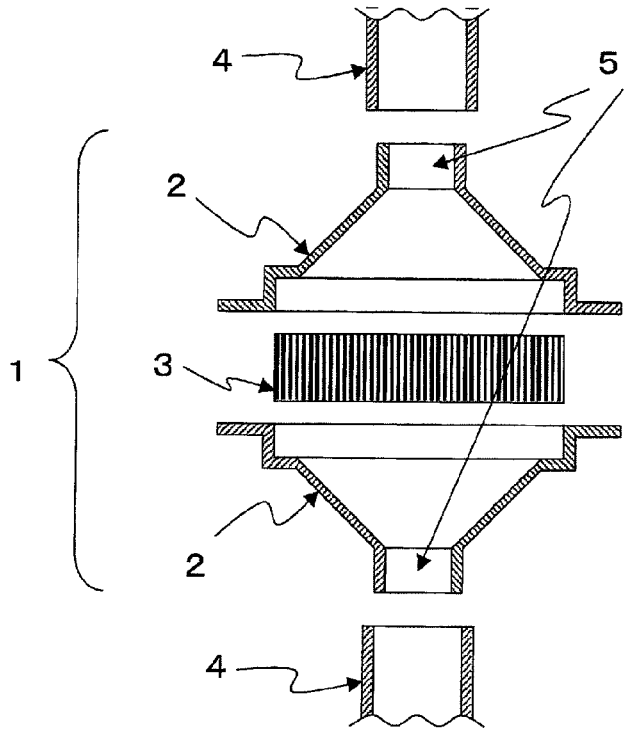
FIG. 1 is a schematic drawing of an embodiment of the structure to form a filter holder of the present invention.

Reference numerals in Figures will be described below.

Figure 2:
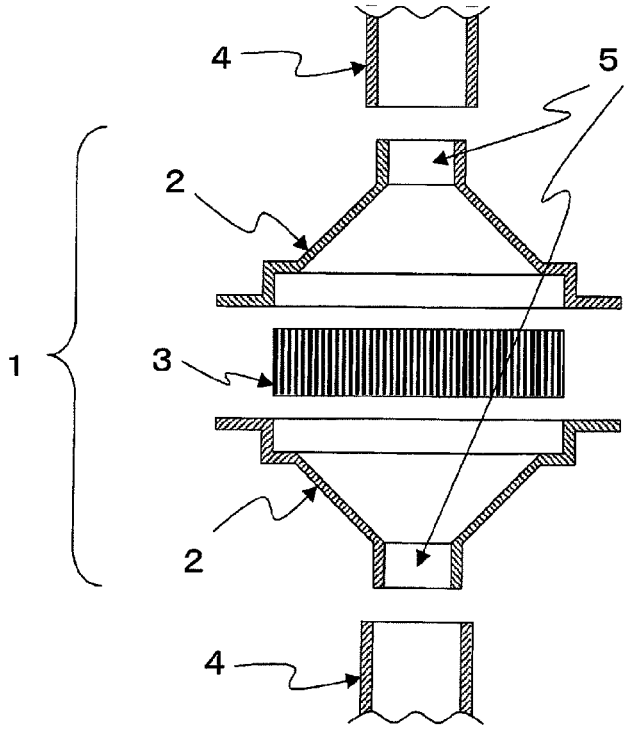
FIG. 2 is a schematic drawing of a part for removing impurities from a molten metal using the structure of FIG. 1 in the state before assembling.
Figure 3:
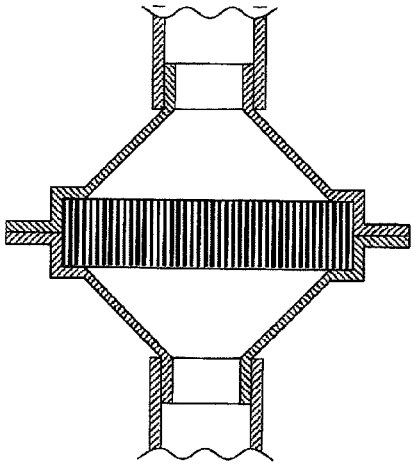
FIG. 3 is a schematic drawing of a part for removing impurities from a molten metal using the structure of FIG. 1 in the state after assembling.
Figure 4:
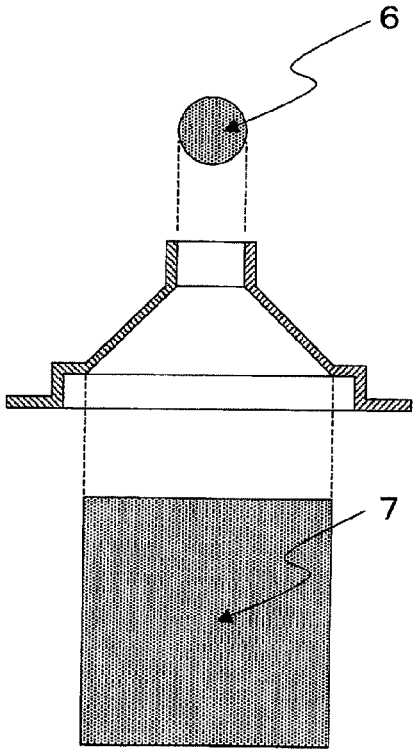
FIG. 4 is a schematic drawing of relationship between a cross-sectional area of a molten metal inlet/outlet part and an effective cross-sectional area of a heat-resistant filter contacting part.

1 part for removing impurities from a molten metal
2 structure to form a filter holder
3 heat-resistant filter
4 runner tube
5 molten metal inlet/outlet part
6 cross-sectional area of a molten metal inlet/outlet part
7 effective cross-sectional area of a heat-resistant filter contacting part
8 adhesive, tackiness agent or double-sided tape
9 stapler, tack, screw, yarn or metal wire
10 clip or adhesive tape
11 honeycomb heat-resistant filter
12 clip or adhesive tape
13 mold
14 product part
15 molten metal
16 flow off
17 part for removing impurities from a molten metal
18 ceramic runner tube
19 sprue runner
21 gate
22 heat-resistant filter The part for removing impurities from a molten metal of the present invention is generally arranged in a runner system that is a supply channel of molten metal. In general, a runner system is constructed of fire-resistant members such as ceramic members. The part preferably has a molten metal inlet part and a molten metal outlet part that can be connected with and fitted to such a runner system. In other words, there are preferably provided molten metal inlet/outlet parts 5 (FIG. 2). The part can be any shape as long as it can pass all of the molten metal to be filtered. FIG. 1 shows an embodiment of the structure to form a filter holder. FIG. 2 shows an embodiment of the part for removing impurities from a molten metal using the structure of the shape in FIG. 1 (before assembling). FIG. 3 shows the embodiment of the part for removing impurities from a molten metal using the structure of the shape in FIG. 1 (after assembling). A cross-sectional shape of the molten metal inlet/outlet part 5 can be of any such as quadrangle or circle, but preferably has a fitting structure to a runner tube 4 for workability in forming a mold and avoidance of sand contamination. At a heat-resistant filter 3, resistance of running molten metal is increased. To avoid this, as shown in FIG. 4, an effective cross-sectional area 7 of a heat-resistant filter contacting part is preferably larger than a cross-sectional area 6 of a molten metal inlet/outlet part.

Since a heat-resistant filter must be inserted in the structure to form a filter holder, the part for removing impurities from a molten metal preferably has a divided construction with two or more of the structure. Such a divided construction preferably makes the structure easy to be formed and makes the part easy to be assembled. The part more preferably has a two-divided construction, from the viewpoints of the small number of a kind of parts forming the structure and economic efficiency. Two of the structures are even more preferably of the same shape.

Figure 5:
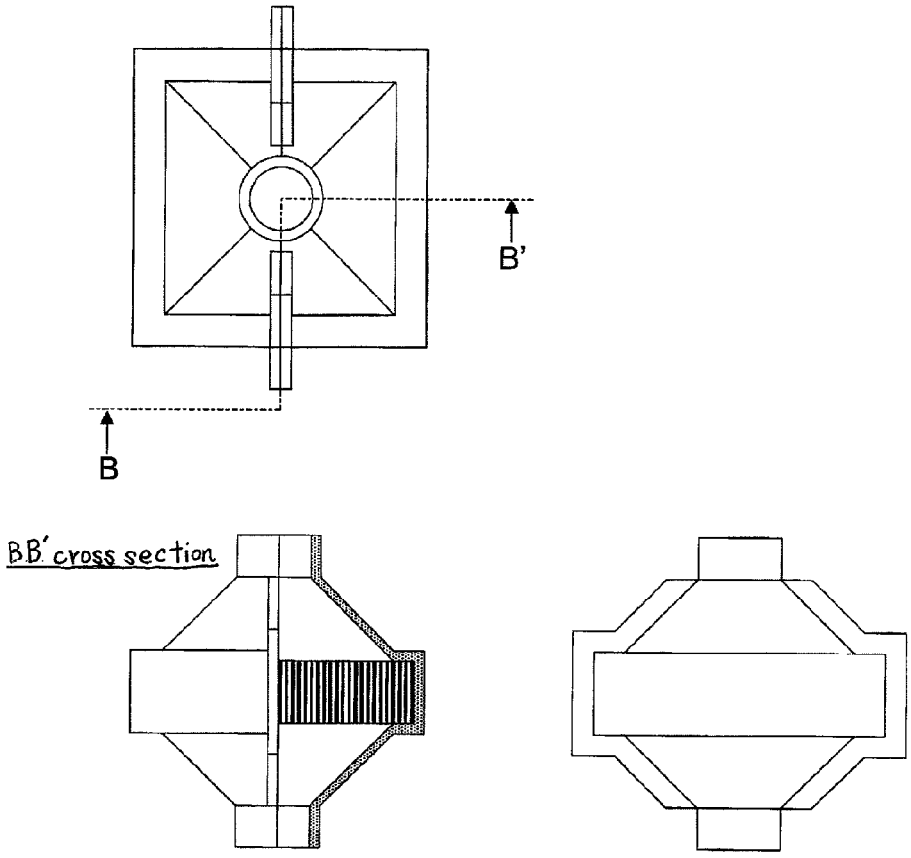
FIG. 5 is a schematic drawing of an embodiment of joining divided structures.
Figure 6:
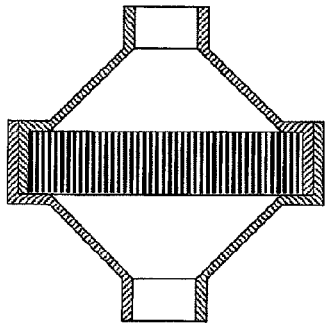
FIG. 6 is a schematic drawing of another embodiment of joining divided structures.

The heat-resistant filter is set in the structure to form a filter holder, and the structure is connected. The structure can be connected in any configuration. For example, the structure may be connected to a face orthogonal to a direction of a molten metal flow as shown in FIG. 3, or to a face parallel to the direction as shown in FIG. 5. Alternatively, the structure may have a fitting construction as shown in FIG. 6.

Figure 7:
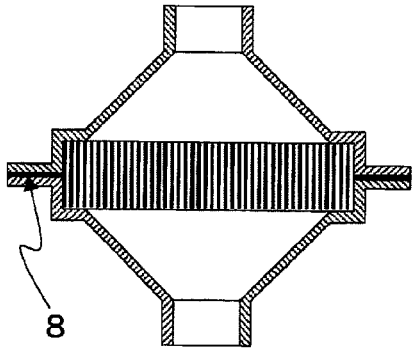
FIG. 7 is a schematic drawing of an embodiment of holding divided structures.
Figure 8:
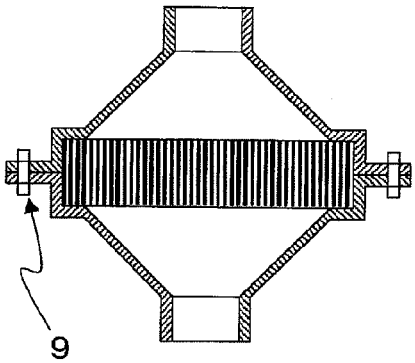
FIG. 8 is a schematic drawing of another embodiment of holding divided structures.
Figure 9:
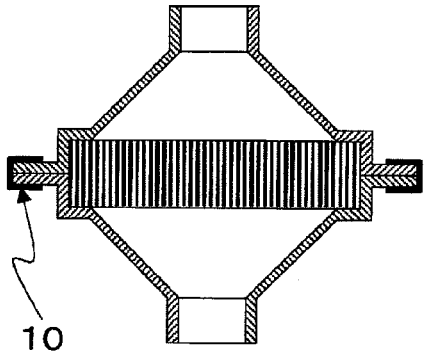
FIG. 9 is a schematic drawing of another embodiment of holding divided structures.
Figure 10:
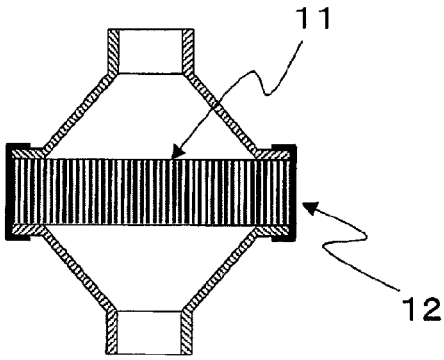
FIG. 10 is a schematic drawing of another embodiment of holding divided structures.

The connecting part is not necessarily hold by means of adhesion or the like if there is no difficulties in handling, but preferably hold by any way for preventing deformation and/or fall off of the heat-resistant filter. For instance, in the case of the connecting construction in FIG. 3, examples of the method of holding include, adhering connecting faces each other with an adhesive/tackiness agent/double-sided tape 8 as shown in FIG. 7, fastening through connecting faces with a stapler/tack/screw/yarn/metal wire 9 as shown in FIG. 8 and locking by holding from the outside with a clip/adhesive tape 10. When the heat-resistant filter is a filter 11 without a communication hole with a molten metal filtering part on its outer peripheral surface like as a perforated filter or a honeycomb filter (e.g., NGK-FILTER "HONEYCERAM"), a molten metal does not leak, and thus the outer peripheral surface of the heat-resistant filter may not be covered with the structure but be locked by holding with a clip/adhesive tape 12 as shown in FIG. 10.

The part for removing impurities from a molten metal of the present invention has excellent effects such as improvement in troublesome waste disposal after use, good strength, lightweight, good workability in forming a mold and prevention of break of a heat-resistant filter. Therefore, the part of the invention can exhibit an effect of producing a cast article in high quality having few cast defect derived from slug or mold sand.

A reason of the effect of the present invention, in particular, of particular prevention of break of a heat-resistant filter is not clear, but thought as follows: the filter holder used in the present invention is composed of the organic fibers, the inorganic fibers and the thermosetting resin and has adequate elasticity and flexibility; it thus can sufficiently ease an external force in forming a mold and thermal strain in pouring a molten metal up; and it can exhibit such a significant effect of prevention of break of the heat-resistant filter.

The mold for producing a cast article of the present invention is provided by arranging the part for removing impurities from a molten metal of the present invention in a runner system for supplying molten metal buried in mold sand, as shown above.

The mold sand can be any sand conventionally used in production of this kind of cast article. The mold sand may not be cured with a binder, or cured according to need.

A runner tube used in the runner system can be of ceramics formed with a fire-resistant member.

From the viewpoint of elimination of contamination of impurities from a sprue at which there are risks for turbulence developed, the part for removing impurities from a molten metal of the present invention is preferably arranged in the runner system of the mold for producing a cast article of the present invention.

The method for producing a cast article according to the present invention includes; pouring a molten metal via the inlet sprue of the mold for producing a cast article; casting the molten metal; cooling the molten metal to a predetermined temperature; releasing a frame to remove a mold sand; and subjecting the cast article to aftertreatments such as trimming according to need.

Since the method for producing a cast article according to the present invention uses the part for removing impurities from a molten metal, the method sufficiently removes slug and the like and prevents contamination of the mold sand, and thus can produce a cast article in high quality.

The present invention has a unique effect of prevention of break of a heat-resistant filter. A heat-resistant filter has been conventionally closely-attached or fitted to a ceramic filter holder with no space therebetween in order to prevent leak of a molten metal to the outside of the holder from the space therebetween and passing of impurities by flowing around the side of the filter. However, the heat-resistant filter thus hold to the ceramic filter holder is in a restrained state, and thus increases an internal stress by thermal strain generated in pouring a molten metal. As a result, the heat-resistant filter would be broken when it cannot withstand the internal stress no longer.

In general, to increase workability and decrease development of misrun in casting, a flow rate of a molten metal in a runner at pouring must be increased as large as possible to increase a casting speed. However, the problem of break of a heat-resistant filter will become pronounced with increased thermal strain of the filter at pouring, that is, increased amount of a molten metal passing through the heat-resistant filter or increased flow rate of a molten metal, or elevated molten metal temperature.

The present invention has good effect of preventing break of a heat-resistant filter, and sufficiently exhibit this effect even when an amount of a molten metal and a flow rate of molten metal are increased, or a molten metal temperature is elevated. Based on the feature of the present invention, an amount of molten metal is preferably not less than 300 kg (based on a cast article weight) per a filter, and more preferably not less than 400 kg. The upper limit thereof is not specifically limited, but preferably not more than 5000 kg. Similarly as above, a flow rate of molten metal is preferably not less than 10 kg/sec per a filter, and more preferably not less than 15 kg/sec. The upper limit thereof is not specifically limited, but preferably not more than 150 kg/sec. Similarly as above, a molten metal temperature is preferably not lower than 1350° C., more preferably not lower than 1380° C., and even more preferably not lower than 1400° C. The upper limit thereof is not specifically limited, but preferably 1600° C. The molten metal temperature is measured immediately before pouring.

When an amount of molten metal passing through a heat-resistant filter is much, the heat-resistant filter used is generally large. An effective cross-sectional area of the heat-resistant filter used in the present invention is thus preferably not less than 25 $cm^2$, more preferably 25 to 400 $cm^2$, even more preferably 50 to 400 $cm^2$, and even more preferably 80 to 400 $cm^2$, from the viewpoint of more effective prevention of break of the heat-resistant filter according to the present invention. The effective cross-sectional area of the heat-resistant filter refers a maxim area of a section orthogonal to a direction of molten metal running with which the molten metal can contact in the state of hold in the filter holder.

Examples of a method for casting generally setting an amount of molten metal passing through a heat-resistant filter and a flow rate of molten metal to large and a molten metal temperature to high include an evaporative pattern casing method. In the evaporative pattern casing method, not to generate soot and residue defects, a flow rate of molten metal must be increased to increase a casting speed. In addition, not to develop misrun due to decreased temperature of the molten metal occurring by thermal decomposition of an evaporative pattern, a molten metal temperature must be high. Therefore, the part for removing impurities from a molten metal of the present invention can exhibit the effect of preventing break of a heat-resistant filter more effectively in the evaporative pattern casing method, and is preferably used in the method.

The present invention is not limited to the embodiment described above, and can be variously modified within the range that does not depart from the scope of the present invention.

EXAMPLES

The following Examples demonstrate the present invention. The Examples are merely illustrative of the present invention and not intended to limit the present invention.

Example 1

<Preparation of a Raw Slurry>

The following organic fibers, inorganic fibers and inorganic particles were dispersed in water to give a slurry of about 1% by weight. Then to the slurry were added the following thermosetting resin and an appropriate amount of the following coagulant to prepare a raw slurry. In preparation, a ratio of organic fibers/inorganic fibers/inorganic particles/thermosetting resin powder was 25/10/45/20 (parts by weight).

organic fibers: waste newspaper (average fiber length: 1 mm, Freeness (CSF, the same hereinafter): 150 cc)

inorganic fibers: PAN-based carbon fiber ("Toreca Chop" available from Toray Industries, Inc., fiber length: 3 mm, shrinkage ratio: 0.1%)

inorganic particles: obsidian ("Nice Catch" available from KINSEI MATEC CO., LTD., average particle diameter: 30 μm)

thermosetting resin: phenol resin ("Bellpearl S-890" available from Air Water Inc.)

coagulant: polyacrylamide-based coagulant ("A110" available from Mitsui Cytec Ltd.)

<Papermaking of a Structure to Form a Filter Holder>

A papermaking mold used had a papermaking face corresponding to the structure 2 shown in FIG. 2. The papermaking face was covered with a net having a predetermined mesh and provided with communication holes communicating with the back surface. The communication holes were connected to a suction pump. In a tank containing the raw slurry was immersed the papermaking mold in such direction that the papermaking face faced downward. Then, the suction pump was actuated to deposit a predetermined fiber laminate on the surface of the net. With continuing the suction pump running, the papermaking mold was taken up above a liquid level of the raw slurry tank, and thereby the fiber laminate was aerated to dehydrate. The fiber laminate was then removed from the papermaking mold and transferred to a drying and shaping mold heated to 220° C. The drying and shaping mold used was constructed of a pair of inner and outer parts corresponding to the structure shown in FIG. 1. In the drying and shaping step, the fiber laminate was sandwiched with the drying and shaping mold constructed of the inner and the outer parts, and dried and shaped to an intended structure transferred from the mold. After a predetermined time (60 seconds) of pressing and drying, the resultant shaped article was taken off from the drying and shaping mold and cooled to give a structure having a thickness of 1.4 mm in the shape of the structure 2 shown in FIG. 2. In the structure, a molten metal inlet/outlet part 5 had an outer diameter of ϕ53 mm.

<Preparation of a Part for Removing Impurities from a Molten Metal>

Two structures as of FIG. 1 were prepared. A heat-resistant filter ("SEDEX 100×100×22-10P" manufactured by Foseco Japan Limited, main ingredient: silicon carbide, effective cross-sectional area: 64 $cm^2$) was set in a predetermined position shown in FIG. 2. These were assembled as shown in FIG. 3. In assembling, connecting parts were hold by wrapping with a stapler as shown in FIG. 8.

<Formation of a Mold>

Figure 11:
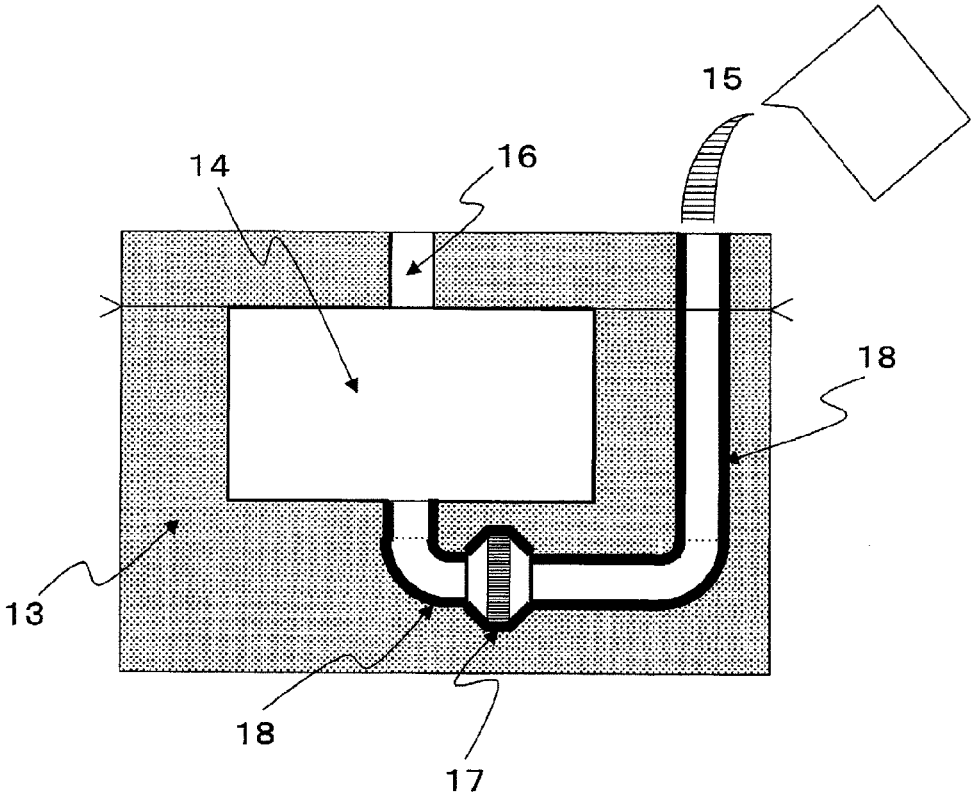
FIG. 11 is a schematic drawing of a casting plan of Example 1.

A mold was formed with a plan as shown in FIG. 11. Arnold 13 was prepared with fluttery sand, a furan resin and a hardening agent. For a runner system, a ceramic runner tube 18 having an inner diameter of ϕ30 mm was used. In the runner system, the part for removing impurities from a molten metal 17 was placed. A product part 14 was W×D×H=400×400×200 mm, which corresponds to a cast article of about 220 kg based on weight.

<Production of a Cast Article>

Into the mold in FIG. 11 was poured a casting material (molten metal) FC-300 at a cast temperature 1380° C. After solidification, a cast article was taken off by breaking the mold.

<Results>

A product was evaluated for presence of defects. The structure to form a filter holder was measured for weight before and after casting. Results are shown in Table 1.

Comparative Example 1

Figure 12:
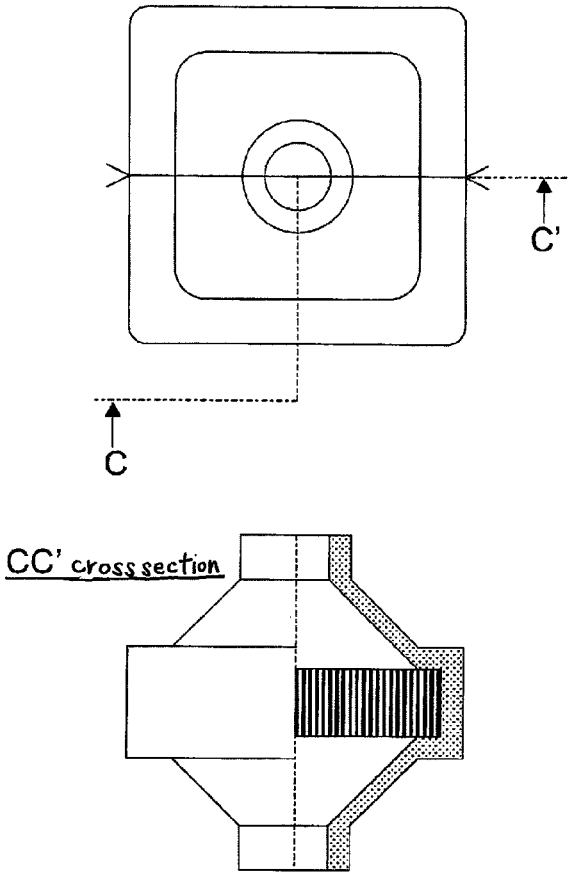
FIG. 12 is a schematic drawing of a part for removing impurities from a molten metal used in Comparative Example 1.

A structure to form a filter holder used in the part for removing impurities from a molten metal was made of ceramics (average thickness of 8 mm) and had a shape as shown in FIG. 12. Connecting parts were hold with a fabric adhesive tape. The other conditions were similar to that in Example 1. Evaluation of presence/absence of defects in a product and weights of the structure to form a filter holder measured before and after casting are shown in Table 1.

Comparative Example 2

Figure 13:
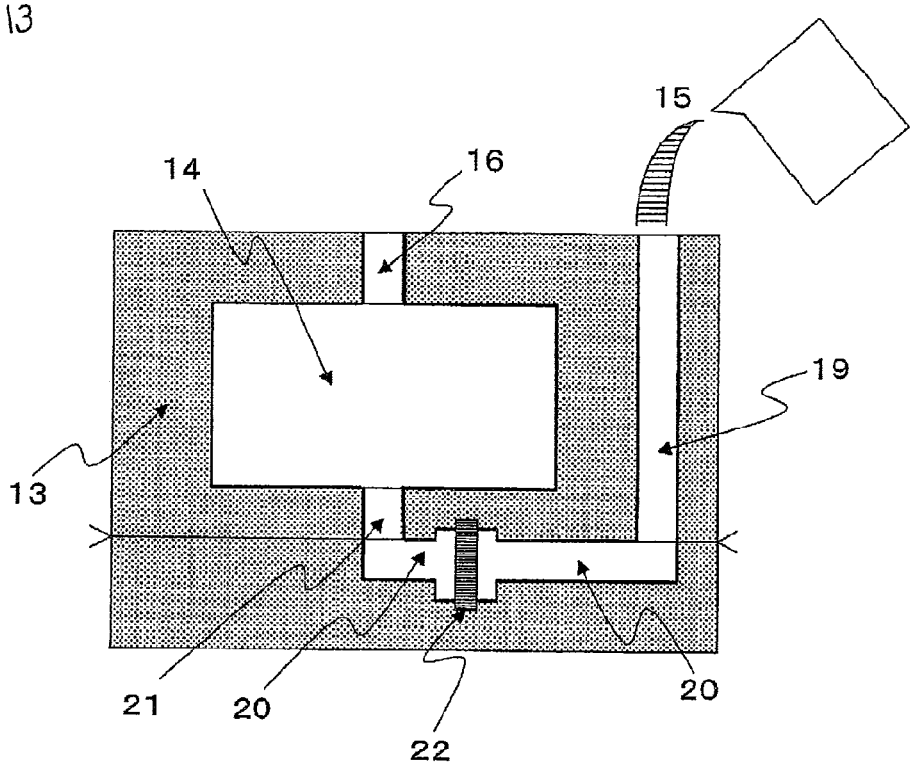
FIG. 13 is a schematic drawing of a casting plan of Comparative Example 2.

Comparative Example 2 was similarly conducted to in Example 1, except that a runner tube was not used in a runner system, cross-sectional shapes of a sprue 19 and a gate 21 each were a circle of ϕ30 (mm), a cross-sectional shape of a runner 20 was a quadrangle of 27×27 (mm), and a heat-resistant filter was directly set in the runner 20 in a mold plan shown in FIG. 13. Evaluation of presence/absence of defects in a product is shown in Table 1.

TABLE 1

| | defects in a product | weight of the structure (g) before casting | weight of the structure (g) after casting |
|---|---|---|---|
| Example 1 | None | 60 | 24 |
| Comparative Example 1 | None | 720 | 714 |
| Comparative Example 2 | sand inclusion | — | — |

It was demonstrated that when the part for removing impurities from a molten metal of the present invention was used, defects did not generate in a product. In addition, in the part used in Example 1, a weight of the structure after casting was very lighter than the ceramic structure. This situation promises reduction of waste.

Example 2, Comparative Example 3

These Examples were similarly conducted to in Example 1 and Comparative Example 1, respectively, except that a product part was W×D×H=560×560×200 (mm) (corresponding to a cast article of about 440 kg based on weight), and a cast temperature was 1450° C. Test production was performed ten times for each Example. Evaluations are shown in Table 2 in term of a rate, in 10 pieces, of defected pieces of products and of breaks of a filter after casting.

In evaluation, break of a filter after casting was performed visually.

TABLE 2

| | rate of defects in a product (the number) | rate of break of a filter (the number) |
|---|---|---|
| Example 2 | 0/10 | 0/10 |
| Comparative Example 3 | 2/10 | 2/10 |

As shown in Example 2, when the part for removing impurities from a molten metal of the present invention was used, the filter did never break and there was no defect in a product. Unlike Example 2, Comparative Example 3 using the ceramic filter holder shows that the filter broke at a rate of two tenth and defects generated in a product.

The difference will become bigger difference in productivity and quality stability particularly with larger production scale of a cast article. Therefore, it is shown that the part for removing impurities from a molten metal of the present invention has excellent effect.

Example 3, Comparative Example 4

<Preparation of a Part for Removing Impurities from a Molten Metal>

Two structures to form a filter holder (having a shape shown in FIG. 10) were prepared similarly to in Example 1. A heat-resistant filter (perforated, outer shape: quadrangle, material: mullite, effective cross-sectional area: 121 $cm^2$) was set in a predetermined position shown in FIG. 10. These were assembled as shown in FIG. 10. Connecting parts were hold by wrapping a paper adhesive tape as Example 3.

Comparative Example 4 was similarly conducted to in Example 3, except that a structure to form a filter holder used in a part for removing impurities from a molten metal was made of ceramics and had a shape as shown in FIG. 12 (average thickness: 8 mm).

<Formation of a Mold>

A mold was formed with a plan as shown in FIG. 11. A pattern of a rectangular parallelepiped shape having dimensions of W×D×H=800×800×400 (mm) was made of foamed polystyrene of an expansion ratio of 50-fold. A coat of the following composition was coated on the surface of the pattern at a dried film thickness of about 1 mm. Then, a heat-resistant aggregate (fluttery sand+furan resin/hardening agent) was filled to form a mold as shown in FIG. 11. In a runner system, a ceramic runner tube 18 having an inner diameter of ϕ50 mm was used. In the runner system, the part for removing impurities from a molten metal 17 was placed. A product part corresponds to a cast article of about 1800 kg based on weight.

composition of coat
silica 28.9 (% by mass)
graphite 13.0 (% by mass)
surfactant 2.0 (% by mass)
bentonite 3.0 (% by mass)
methylcellulose 6.0 (% by mass)
water residual part (total 100% by mass)

<Production of a Cast Article>

Into the mold in FIG. 11 was poured a casting material (molten metal) FC-300 at a cast temperature 1450° C. After solidification, a cast article was taken off by breaking the mold.

<Results>

Production of a cast article was conducted ten times according to the method. Presence of defects in a product and break of a filter after casting are evaluated with a rate thereof to 10 pieces of the product. In evaluation, break of a filter after casting was performed visually.

TABLE 3

| | rate of defects in a product (the number) | rate of break of a filter (the number) |
|---|---|---|
| Example3 | 0/10 | 0/10 |
| Comparative example 4 | 4/10 | 4/10 |

As shown in Example 3, when the part for removing impurities from a molten metal of the present invention was used, the filter did never break and there was no defect in a product. Unlike Example 3, Comparative Example 4 using the ceramic filter holder shows that the filter broke at a rate of four tenth and defects generated in a product.

The difference will become bigger difference in productivity and quality stability particularly with larger production scale of a cast article. Therefore, it is shown that the part for removing impurities from a molten metal of the present invention has excellent effect.

Figure 14:
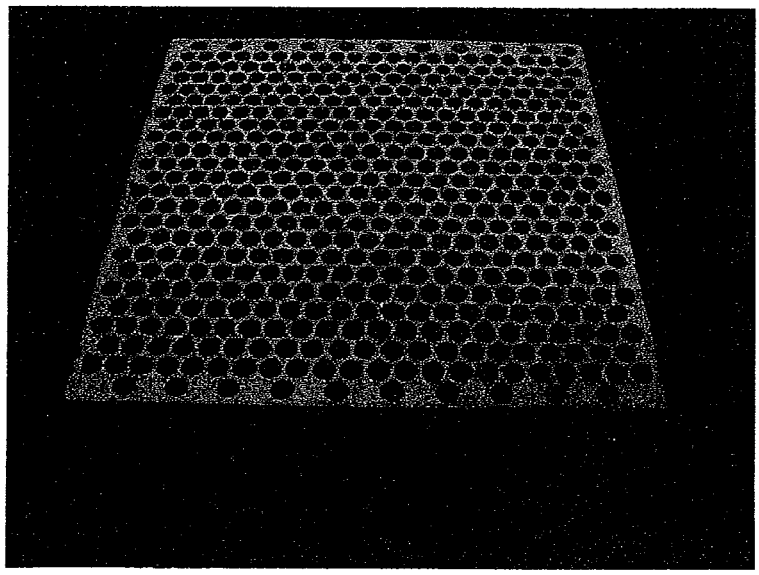
FIG. 14 is a state photograph of a heat-resistant filter before casting.
Figure 1:
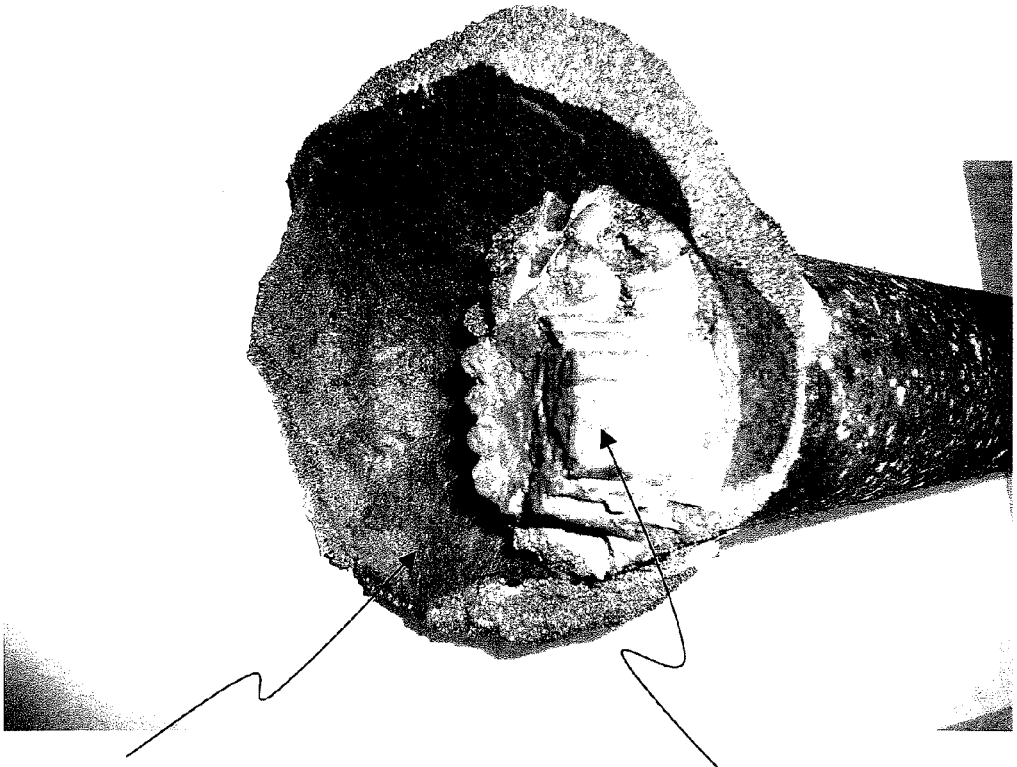

A state photograph of the heat-resistant filter before casting is shown in FIG. 14. A state photograph of the filter holder and the heat-resistant filter after casting in Comparative Example 4 is shown in FIG. 15. In Comparative Example 4, significant break of the heat-resistant filter as shown in FIG. 15 occurs in high rate. In Example 3, such break of the filter did never occur.

The invention claimed is:

1. A method for producing a cast article, comprising the steps of:

providing a heat-resistant filter and a pair of structures to form a filter holder;

assembling a part for removing impurities from a molten metal by disposing the heat-resistant filter between the structures to form the filter holder, so that the part comprises the filter holder and the heat-resistant filter, the filter holder being constituted of a structure comprising an organic fiber, an inorganic fiber and a thermosetting resin;

burying the part in a molding sand so that the part is joined between runner tubes, which are components from the part, to form a runner system of a mold where impurities from a molten metal are removed; and pouring the molten metal through the part into the mold so as to cast the molten metal, wherein the amount of molten metal to be poured is 300 kg to 5000 kg, based on a cast article weight, per filter, and the temperature of the molten metal is not lower than 1350° C. and not higher than 1600° C.;

wherein a flow rate of molten metal is from 10 kg/sec to 150 kg/sec, per filter.

2. The method according to claim 1, wherein the heat-resistant filter is made of ceramics.

3. The method according to claim 1, wherein an effective cross-sectional area of the heat-resistant filter is not less than 25 $cm^2$.

4. The method according to claim 1, wherein the inorganic fiber is carbon fiber.

5. The method according to claim 1, wherein the contents of the organic fiber, the inorganic fiber and the thermosetting resin are 1 to 50 parts by weight, 1 to 40 parts by weight and 2 to 50 parts by weight, respectively, to the total of 100 parts by weight of these three components.

6. The method according to claim 1, wherein the structure further comprises inorganic particles.

7. The method according to claim 1, wherein the filter holder has a molten metal inlet part and a molten metal outlet part, which are capable to be fitted with and connected to a molten metal supplying channel.

8. The method according to claim 1, wherein the amount of molten metal is 400 kg to 5000 kg, based on a cast article weight, per filter.

9. The method according to claim 1, wherein the amount of molten metal is 400 kg to 1800 kg, based on a cast article weight, per filter.

10. The method according to claim 1, wherein the amount of molten metal is 440 kg to 1800 kg, based on a cast article weight, per filter.

11. The method according to claim 1, wherein an effective cross-sectional area of the heat-resistant filter is 25 to 400 $cm^2$.

12. The method according to claim 1, wherein an effective cross-sectional area of the heat-resistant filter is 64 to 121 $cm^2$.

13. The method according to claim 6, wherein the content of the organic fiber is 4 to 30 parts by weight, the content of the inorganic fiber is 4 to 20 parts by weight, the content of the inorganic particles is 30 to 85 parts by weight and the content of the thermosetting resin is 6 to 30 parts by weight, the contents being to the total of 100 parts by weight of these four components.

14. The method according to claim 1, wherein the temperature of the molten metal is not lower than 1380° C.

15. The method according to claim 1, wherein the temperature of the molten metal is not lower than 1400° C.

16. The method according to claim 1, wherein the runner tubes are ceramic tubes, the filter holder is burnable, and the heat-resistant filter is made of ceramics.

17. The method according to claim 6, wherein the inorganic particles are obsidian or mullite powder.

18. A method for producing a cast article, comprising the steps of:

providing a heat-resistant filter and a pair of structures to form a filter holder;

assembling a part for removing impurities from a molten metal by disposing the heat-resistant filter between the structures to form the filter holder, so that the part comprises the filter holder and the heat-resistant filter, the filter holder being constituted of a structure comprising an organic fiber, an inorganic fiber and a thermosetting resin;

burying the part in a molding sand so that the part is joined between runner tubes, which are different components from the part, to form a runner system of a mold where impurities from a molten metal are removed; and pouring the molten metal through the part into the mold so as to cast the molten metal, wherein the amount of molten metal to be soured is 300 kg to 5000 kg, based on a cast article weight, per filter, and the temperature of the molten metal is not lower than 1350° C. and not higher than 1600° C.;

wherein a flow rate of molten metal is from 10 kg/sec to 150 kg/sec, per filter;

wherein the method is an evaporative pattern casting method.

19. A method for producing a cast article, comprising the steps of:

providing a heat-resistant filter and a pair of structures to form a filter holder;

assembling a part for removing impurities from a molten metal by disposing the heat-resistant filter between the structures to form the filter holder, so that the part comprises the filter holder and the heat-resistant filter, the filter holder being constituted of a structure comprising an organic fiber, an inorganic fiber, inorganic particles and a thermosetting resin;

burying the part in a molding sand so that the part is joined between runner tubes, which are different components from the part, to form a runner system of a mold where impurities from a molten metal are removed; and pouring the molten metal through the part into the mold so as to cast the molten metal, wherein the heat-resistant filter is made of ceramics; the inorganic fiber is carbon fiber, the content of the organic fiber is 4 to 30 parts by weight; the content of the inorganic fiber is 4 to 20 parts by weight; the content of the inorganic particles is 30 to 85 parts by weight and the content of the thermosetting resin is 6 to 30 parts by weight, the contents being to the total of 100 parts by weight of these four components, the amount of molten metal is 440 kg to 1800 kg, based on a cast article weight, per filter, an effective cross-sectional area of the heat-resistant filter is 64 to 121 $cm^2$, and the temperature of the molten metal is not lower than 1350° C. and not higher than 1600° C.;

wherein a flow rate of molten metal is from 10 kg/sec to 150 kg/sec, per filter.

20. The method according to claim 19, which is an evaporative pattern casting method.

21. The method according to claim 19, wherein the runner tubes are ceramic tubes and the filter holder is burnable.

22. The method according to claim 19, wherein the temperature of the molten metal is not lower than 1380° C.

23. The method according to claim 19, wherein the temperature of the molten metal is not lower than 1400° C.

24. The method according to claim 19, wherein the inorganic particles are obsidian or mullite powder.

* * * * *